US008328191B2

(12) United States Patent
Tamura et al.

(10) Patent No.: US 8,328,191 B2
(45) Date of Patent: Dec. 11, 2012

(54) SHEET MATERIAL DETECTION APPARATUS AND RECORDING APPARATUS

(75) Inventors: Tetsuya Tamura, Matsumoto (JP); Akira Nemura, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/015,812

(22) Filed: Jan. 28, 2011

(65) Prior Publication Data

US 2011/0187049 A1 Aug. 4, 2011

(30) Foreign Application Priority Data

Jan. 29, 2010 (JP) ..... 2010-018329

(51) Int. Cl.
*B65H 7/02* (2006.01)

(52) U.S. Cl. ..... 271/265.01; 271/258.01

(58) Field of Classification Search ..... 271/265.01, 271/258.01

See application file for complete search history.

(56) References Cited

U.S. PATENT DOCUMENTS 5,882,130 A * 3/1999 Kumazaki et al. ..... 400/642
6,152,443 A * 11/2000 Claramunt et al. ..... 271/258.05
7,021,622 B2 * 4/2006 Carter et al. ..... 271/258.01

FOREIGN PATENT DOCUMENTS

JP 10114446 A * 5/1998
JP 11059961 A * 3/1999
JP 2007-031003 2/2007

* cited by examiner

*Primary Examiner* — Luis A Gonzalez
(74) *Attorney, Agent, or Firm* — Workman Nydegger

(57) ABSTRACT

A sheet material detection apparatus detects passage of a sheet material over a sheet material transportation path. The apparatus includes: a lever member that is exposed over the transportation path and turns from a reference position when the sheet material is brought into contact therewith; a detecting section that detects the turn of the lever member; a holder that supports the lever member in such a manner that the lever member can turn freely toward both sides in a direction of the transportation of the sheet material at a guide-facing-surface side, the guide facing surface being a surface facing a guide surface along which the sheet material is guided over the transportation path; and a counter weight with which the turning lever member is brought into contact, the counter weight turning due to contact with the lever member, the counter weight being thereafter brought into contact with the holder.

5 Claims, 11 Drawing Sheets

SHEET MATERIAL DETECTION APPARATUS AND RECORDING APPARATUS

The entire disclosure of Japanese Patent Application No. 2010-018329, filed Jan. 29, 2010 is expressly incorporated by reference herein.

BACKGROUND

1. Technical Field

The present invention relates to a sheet material detection apparatus and a recording apparatus.

2. Related Art

A copying machine, a printer, and a fax machine are known as examples of a recording apparatus that records characters, images, or the like on various kinds of a sheet material such as paper, cloth, film, or the like. A sheet material detection apparatus that detects the passage of a sheet material is provided in such a recording apparatus. A lever member that turns when a sheet material is brought into contact therewith is provided on a sheet material transportation path. A detecting section detects the turn of the lever member, thereby detecting the passage of the sheet material. A sheet material detection apparatus that prevents the generation of noise due to the collision of a lever member with a stopper for stopping the movement of the lever member and chattering due to the mechanical vibration of the lever member is disclosed in JP-A-2007-031003. To prevent the noise and chattering, the apparatus is provided with a braking mechanism that reduces the speed of the lever member before it collides with the stopper.

The above sheet material detection apparatus of related art has the following problems. In recent recording apparatuses, a configuration for performing double-side printing on a sheet material to use resources efficiently or due to other reasons is adopted. To perform double-side printing, it is necessary to guide a sheet material into a turnover transportation path by transporting it in the direction opposite to the forward direction. However, since the lever member of the sheet material detection apparatus disclosed in JP-A-2007-031003 can turn in one direction only, specifically, the forward direction only, it cannot be used for detecting the passage of a sheet material when double-side printing is performed.

A stopper has to be removed if a configuration in which a lever member can turn toward both sides in the direction of transportation of a sheet material is adopted in order to detect the passage of the sheet material when double-side printing is performed. The removal of the stopper makes chattering caused by the lever member more likely to occur. To prevent chattering, the number of parts has to be increased. Moreover, in such a type of a sheet material detection apparatus, there is a possibility that a sheet material transported along a guide surface comes away from the guide surface and is raised depending on the position where the lever member is provided. The position of the lever member has to be determined carefully due to its influence on the transportation of a sheet material.

SUMMARY

An advantage of some aspects of the invention is to provide a sheet material detection apparatus and a recording apparatus that can detect the passage of a sheet material during forward and backward feeding and prevent chattering caused by a lever member.

A sheet material detection apparatus according to a first aspect of the invention, which detects passage of a sheet material over a sheet material transportation path, includes: a lever member that is exposed over the transportation path and moves to change its position from a reference position when the sheet material is brought into contact therewith; a detecting section that detects the change in the position of the lever member; a holder that supports the lever member in such a manner that the lever member can turn freely toward both sides in a direction of the transportation of the sheet material at a guide-facing-surface side, the guide facing surface being a surface facing a guide surface along which the sheet material is guided over the transportation path; and a counter weight with which the lever member moving to change the position is brought into contact, the counter weight moving to change its position due to contact with the lever member, the counter weight being thereafter brought into contact with the holder. With such a structure, since the holder supports the lever member in such a manner that the lever member can turn freely toward both sides in the direction of the transportation of a sheet material, the sheet material can be brought into contact with the lever member both during forward feeding and backward feeding. The lever member can move to change its position toward both sides. In addition, since the holder exposes the lever member from the guide-facing-surface side toward the transportation path, it is possible to hold a sheet material along the guide surface by means of the lever member. To provide a solution to the problem of chattering, the counter weight that can move to change its position by utilizing the law of conservation of energy is provided. When the turning lever member is brought into contact with the counter weight, kinetic energy exchange occurs. The counter weight receives the kinetic energy of the lever member to move to change its position while stopping the lever member. The counter weight transfers its kinetic energy to the holder and allows it to escape. By this means, it is possible to avoid chattering caused by the lever member.

In a preferred structure, the sheet material detection apparatus according to the first aspect of the invention further includes an urging member that urges the lever member after the change in the position toward the reference position. With the adoption of the above structure, it is possible to make the speed of the return movement of the raised lever member to the reference position higher. Even when the lever member overshoots beyond the reference position due to the return movement, an urging force acts from the overshoot position toward the reference position. Therefore, it is possible to attenuate the vibration of the lever member speedily.

In a preferred structure, the urging member is, for urging, in engagement with an engagement portion of the lever member that is located at a side opposite to a side of a contact portion of the lever member with a rotating shaft of the lever member being supported by the holder between the engagement portion and the contact portion, which is a portion with which the sheet material is brought into contact. With such a preferred structure, since an urging force is applied to the engagement portion that is located at the side opposite to the side of the contact portion with the rotating shaft being provided between the engagement portion and the contact portion, it is possible to avoid the urging member from being exposed over the transportation path. Therefore, it is not obstructive when the sheet material is transported.

In a preferred structure, a distance from the rotating shaft to the engagement portion is shorter than a distance from the rotating shaft to the contact portion. Since the distance from the rotating shaft to the engagement portion is shorter than the distance from the rotating shaft to the contact portion, position-change stroke at the time of the turn of the lever member for the engagement portion is shorter than that for the contact portion. Therefore, the movement range of the engagement portion at the guide-facing-surface side does not occupy too much space. Thus, it is possible to reduce the size of an apparatus and save space.

In a preferred structure, the holder includes a restricting portion with which the counter weight is brought into contact, thereby restricting return movement of the counter weight due to its own weight after the change in the position at a side in front of a position where the counter weight would be otherwise brought into contact with the lever member that is in the reference position. Since the counter weight turning back due to its own weight is brought into contact with the restricting portion in front of the position where the counter weight would be otherwise brought into contact with the lever member that is in the reference position, collision does not occur between the lever member and the counter weight during the return movement. In addition, it is possible to efficiently transfer its kinetic energy to the holder at the position where the speed of the return movement is the highest.

In a preferred structure, the counter weight can turn freely around a predetermined axis; and the holder restricts a range in which the counter weight can turn between a substantially horizontal position, which is a position where the counter weight is brought into contact with the restricting portion, and a roughly vertical position, which is a position where the counter weight is brought into contact with a second restricting portion, which is provided above the substantially horizontal position. With such a preferred structure, the turn of the counter weight is restricted to an angular range of approximately 90° between the substantially horizontal position and the roughly vertical position. A force for returning to the substantially horizontal position due to its own weight acts on the raised counter weight.

A recording apparatus according to a second aspect of the invention includes the sheet material detection apparatus according to the first aspect of the invention; and a recording section that performs recording processing on the sheet material transported over the transportation path. Since a recording apparatus includes a sheet material detection apparatus that can detect the passage of a sheet material during forward and backward feeding and prevent chattering caused by a lever member, it is possible to detect the passage of the sheet material when double-side printing is performed.

BRIEF DESCRIPTION OF THE DRAWINGS

The invention will be described with reference to the accompanying drawings, wherein like numbers reference like elements.

DESCRIPTION OF EXEMPLARY EMBODIMENTS

With reference to the accompanying drawings, a sheet material transportation apparatus and a recording apparatus according to an exemplary embodiment of the invention will now be explained. Where necessary, different scales are used for members illustrated in each of the accompanying drawings referred to in the following explanation so that each of the members has a size that can be recognized easily. In the present embodiment of the invention, an ink-jet printer (hereinafter referred to as "printer") is taken as an example of a recording apparatus according to an aspect of the invention.

Figure 1:
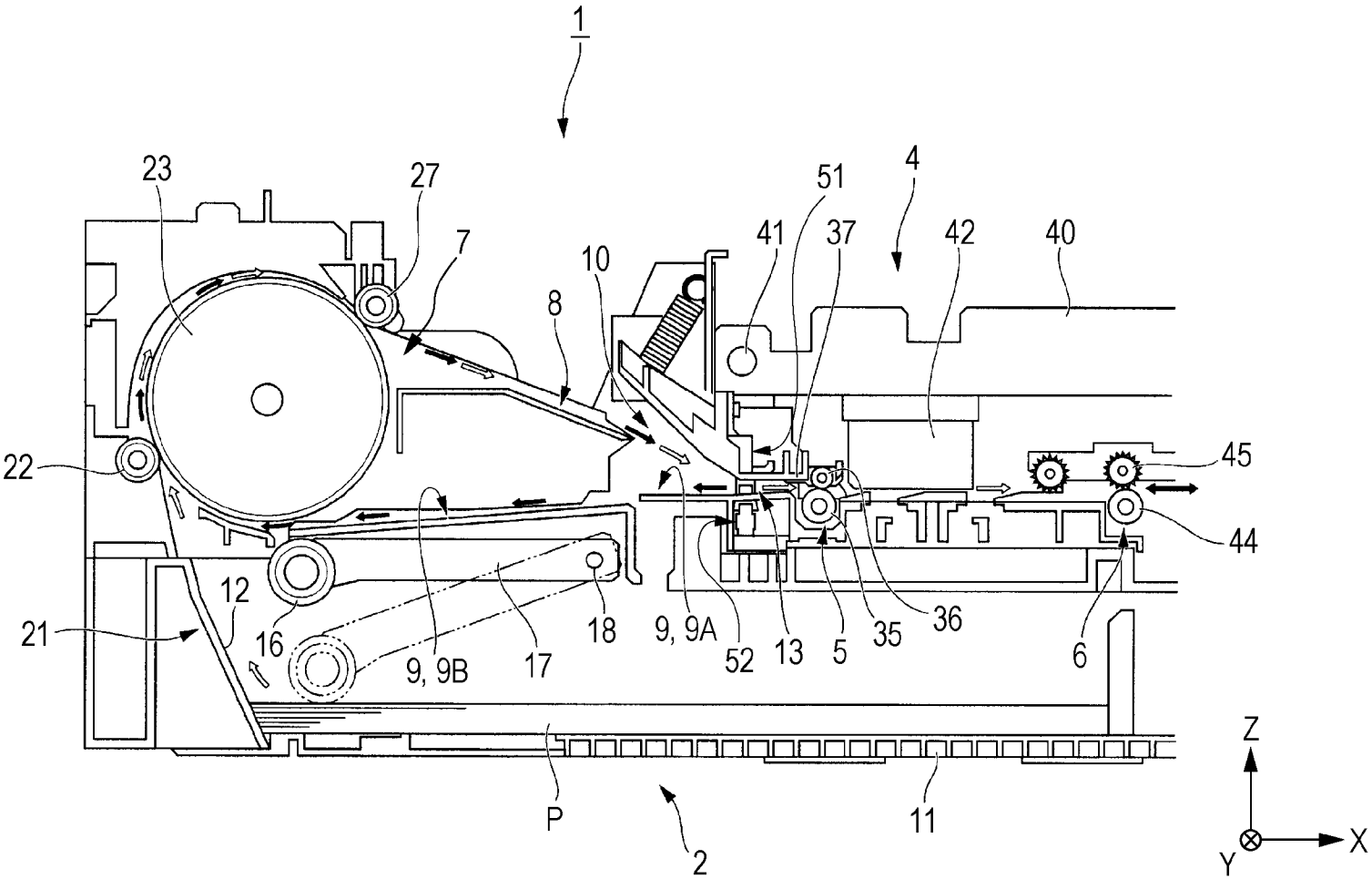
FIG. 1 is a sectional side view that schematically illustrates an example of paper transportation paths of a printer according to an exemplary embodiment of the invention.

FIG. 1 is a sectional side view that schematically illustrates an example of paper transportation paths of a printer 1 according to an exemplary embodiment of the invention. In some of the accompanying drawings, an XYZ three-dimensional orthogonal coordinate system is set as illustrated in FIG. 1. In the following description, positional relationship between respective members may be explained with reference to the XYZ orthogonal coordinate system. A given direction in a horizontal plane is defined as X-axis direction. The direction that is orthogonal to the X-axis direction in the horizontal plane is defined as Y-axis direction. The direction orthogonal to both the X-axis direction and the Y-axis direction, that is, the direction perpendicular to the horizontal plane, is defined as Z-axis direction.

With reference to FIG. 1, the overall configuration of the printer 1 will now be explained. In FIG. 1, in order to show rollers that are provided on the paper transportation paths of the printer 1, almost all rollers are shown on the same plane. However, the actual positions of the rollers in the depth direction (i.e., the Y-axis direction) are not always the same as one another (some of the rollers are provided at the same Y-axis position).

The printer 1 includes a paper-feed device 2 and a recording device 4. The paper-feed device 2 picks up and feeds one sheet of paper (sheet material) P, which is an example of a recording target medium, at a time in a sequential manner. The recording device 4 performs ink-jet recording operation on the paper P. After the completion of recording, the paper P is ejected toward an ejected-paper stacker, which is not illustrated in the drawing. The ejected-paper stacker is provided at the front part (+X side) of the printer 1. A double-side printing (duplex printing) unit 7 is detachably attached to the rear of the printer 1. The double-side printing unit 7 turns over the paper P by transporting the paper P along its curved path so that a second face of the paper P, which is the reverse of a first face on which an image or the like has already been printed, can face a recording head 42. By this means, it is possible to print an image on both the front and the back of the paper P.

The paper-feed device 2 includes a paper cassette 11, a pickup roller 16, and a paper separator 21. A plurality of sheets of the paper P can be loaded in the paper cassette 11 in a stacked state. The paper cassette 11 is detachably attached from a frontal space to the device body of the paper-feed device 2. The pickup roller 16 rotates when driven by a motor that is not illustrated in the drawing. The pickup roller 16 is provided on a pivotable arm member 17 that can pivot around a pivot shaft 18. The pickup roller 16 turns in contact with the uppermost one of sheets of the paper P stacked in the paper cassette 11. By this means, the uppermost sheet(s) of the paper P is picked up and then fed from the paper cassette 11 in the −X direction (paper-feed direction).

A separating member 12 is provided at a front-edge position, which is near the front edges of the sheets of the paper P stacked in the paper cassette 11. In the case of multi feeding (double feeding), the uppermost sheet of the paper P, which should be fed, moves downstream while being in sliding contact with separating member 12 and, therefore, the uppermost sheet of the paper P is separated from the second and subsequent sheets of the paper P from the top. This process is referred to as a first paper separation step. The paper separator 21 that carries out a second paper separation step is provided downstream of the separating member 12. The paper separator 21 includes a separation roller 22 and an intermediate roller 23. An assist roller 27 is provided downstream of the paper separator 21. The assist roller 27 rotates as a follower, that is, a driven roller, in a state in which the paper P is nipped (pinched) between the intermediate roller 23 and the assist roller 27.

The paper-feed device 2 includes a transportation unit 5 and an ejection unit 6. The transportation unit 5 includes a transportation driving roller 35 and a transportation driven roller 36. The transportation driving roller 35 rotates when driven by the motor that is not illustrated in the drawing. The transportation driven roller 36 rotates as a follower while being in pressure contact with the transportation driving roller 35. A guide facing portion 37 rotatably supports the transportation driven roller 36. The transportation unit 5 transports the paper P to a recording position where the paper P faces the recording head 42 with high precision.

A paper edge detection sensor (sheet material detection apparatus) 13 is provided on the guide facing portion 37, which is provided upstream of the transportation unit 5. The paper edge detection sensor 13 is a sensor that detects the position of the front edge of the paper P and the position of the rear edge thereof. In the present embodiment of the invention, a mechanical sensor that detects the edges of the paper P by using its mechanical means is provided as the paper edge detection sensor 13. More specifically, the paper edge detection sensor 13 includes a lever member. The lever member is exposed from the guide facing portion 37 (guide-facing-surface side) toward, and over, a second transportation path 9 (described later). The lever member can turn around a shaft that extends in the Y-axis direction. The lever member turns when the paper P is brought into contact with, and then applies a pressing force to, a regional part of the lever member. The paper edge detection sensor 13 detects the turning of its lever member, thereby detecting the edges of the paper P.

A "nip and spit" skew correction method is used to correct the skew of the paper P that is fed by the paper-feed device 2. The transportation driving roller 35 (a first transportation roller) and the intermediate roller 23 (a second transportation roller), which is provided upstream of the transportation driving roller 35, are used for the skew correction.

The skew-correcting operation is performed as follows. The front edge of the paper P is nipped between the transportation driving roller 35 and the transportation driven roller 36. In this nipped state, the paper P is fed forward (toward the downstream side) by a predetermined feeding amount. Thereafter, the transportation driving roller 35 is rotated in the reverse direction in a state in which the intermediate roller 23, which is provided upstream of the transportation driving roller 35, is rotated in the normal (feed-forward) direction so as to spit out the front edge of the paper P backward (toward the upstream side). As a result, the paper P, which is flexible, deflects between the intermediate roller 23 and the transportation driving roller 35. The position of the front edge of the paper P is adjusted in accordance with the nip point between the transportation driving roller 35 and the transportation driven roller 36. The skew of the paper P is corrected in this way.

The recording head 42 is mounted to the bottom of a carriage 40. When driven by a motor that is not illustrated in the drawing, the carriage 40 reciprocates in a main scan direction (the Y-axis direction) while being guided along a carriage-guiding shaft 41, which extends in the main scan direction. The recording head 42 can eject ink corresponding to, for example, yellow (Y), magenta (M), cyan (C), and black (K).

The ejection unit 6, which is provided downstream of the recording head 42, includes an ejection driving roller 44 and an ejection driven roller 45. The ejection driving roller 44 rotates when driven by the motor that is not illustrated in the drawing. The ejection driven roller 45 rotates as a follower while being in contact with the ejection driving roller 44. After the completion of recording by the recording device 4, the ejection unit 6 ejects the paper P into the ejected-paper stacker (not shown), which is provided at the front part of the printer 1.

The paper-feed device 2 includes a first transportation path 8, the aforementioned second transportation path 9, and a junction region 10. The paper P is transported over the first transportation path 8 at a predetermined height. The paper P is transported over the second transportation path 9 at a certain height that is less than the height of the first transportation path 8. The first transportation path 8 and the second transportation path 9 join together at the junction region 10. The separation roller 22, the intermediate roller 23, and the assist roller 27 transport the paper P over the first transportation path 8. The transportation driving roller 35, the transportation driven roller 36, the ejection driving roller 44, and the ejection driven roller 45 transport the paper P over the second transportation path 9.

The second transportation path 9 (9A) that is located downstream of the junction region 10 functions as a common transportation path for guiding the paper P to the recording position where the paper P faces the recording head 42. On the other hand, the second transportation path 9 (9B) that is located upstream of the junction region 10 functions as a paper turnover transportation path that joins the first transportation path 8, which is located upstream of the junction region 10. Double-side printing is performed as follows. The paper P is transported over the second transportation path 9A. An image or the like is printed on the first face of the paper P. Then, due to the backward feeding operation of the transportation unit 5 and the ejection unit 6, the paper P is fed into the second transportation path 9B with its one edge being the leading edge thereof in the course of the backward feeding, wherein this one edge was the rear edge thereof when printing was performed on the first face thereof. The paper P is guided into the nip between the separation roller 22 and the intermediate roller 23.

The intermediate roller 23 rotates in the clockwise direction shown in FIG. 1 when driven by the motor (not shown). After having been guided into the nip between the separation roller 22 and the intermediate roller 23, the paper P moves as the intermediate roller 23 rotates clockwise to pass through the nip between the intermediate roller 23 and the assist roller 27 and then reach the junction region 10 again. The paper P is transported over the second transportation path 9A again to be fed toward the recording device 4. Thereafter, the recording device 4 prints an image on the second face of the paper P as done on the first face thereof.

Note that the same motor drives, for rotation, the pickup roller 16, the intermediate roller 23, the transportation driving roller 35, and the ejection driving roller 44 that are provided on the paper transportation paths explained above.

Figure 2:
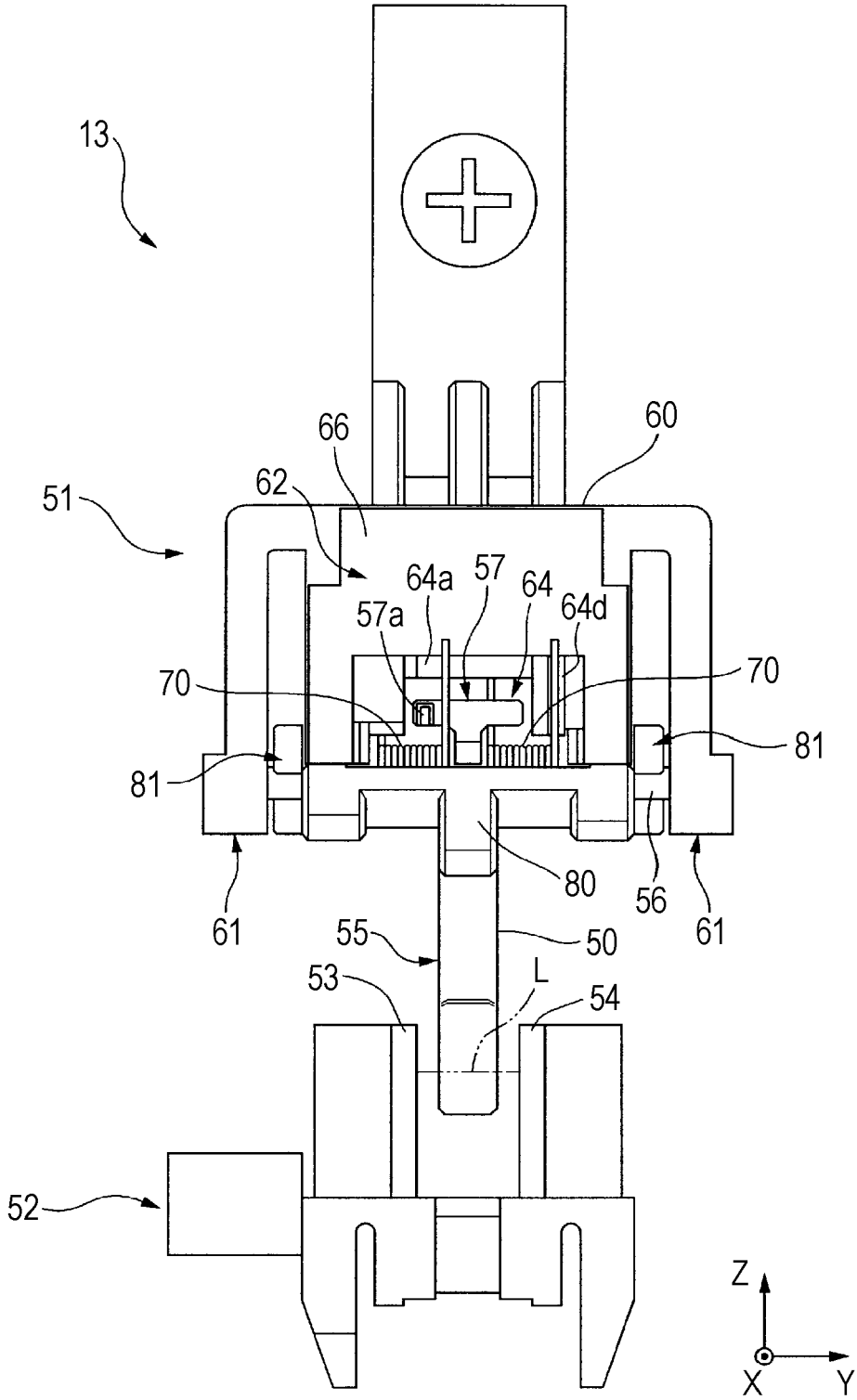
FIG. 2 is a front view that schematically illustrates an example of the structure of a paper edge detection sensor according to an exemplary embodiment of the invention.
Figure 3:
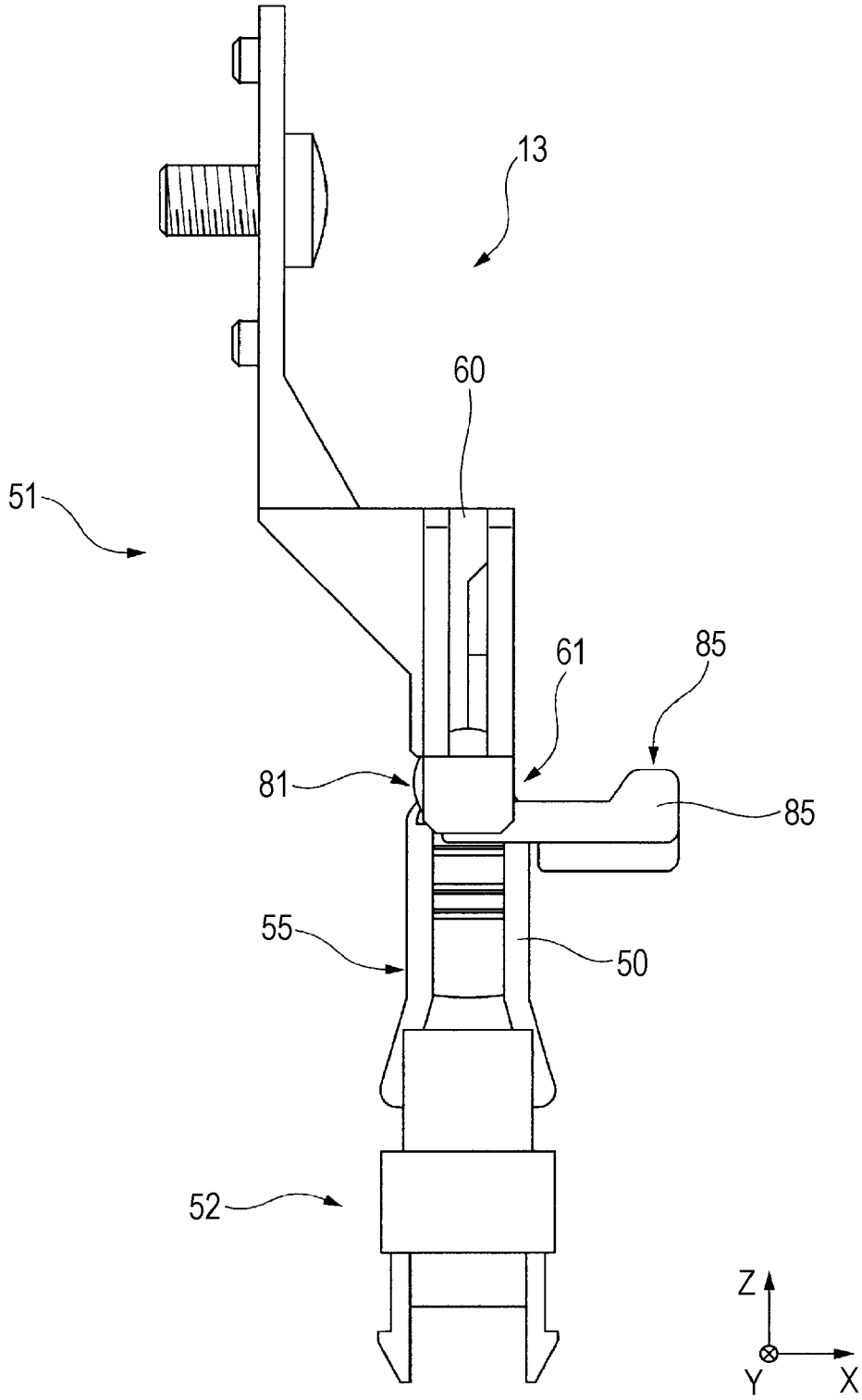
FIG. 3 is a left side view that schematically illustrates an example of the structure of the paper edge detection sensor according to an exemplary embodiment of the invention.

Next, with reference to FIGS. 2 to 7, the characteristic structure of the paper edge detection sensor 13 according to the present embodiment of the invention will now be explained. FIG. 2 is a front view that schematically illustrates an example of the structure of the paper edge detection sensor 13 according to the present embodiment of the invention. FIG. 3 is a left side view that schematically illustrates an example of the structure of the paper edge detection sensor 13 according to the present embodiment of the invention.

The paper edge detection sensor 13 includes an actuator portion 51 and a detector portion 52. The actuator portion 51 includes a lever member 50 that moves to change its position (turns) when the paper P is brought into contact with, and then applies a pressing force to, a regional part thereof. The detector portion 52 detects the change in the position, that is, displacement movement (turning), of the lever member 50. The detector portion 52 is provided on the back of a guide surface (supporting surface) of the second transportation path 9 (refer to FIG. 1). The actuator portion 51 is provided on the guide facing portion 37, which faces the guide surface of the second transportation path 9. The lever member 50 of the actuator portion 51 is exposed from the guide facing portion 37 toward the second transportation path 9. The lever member 50 extends through the guide surface of the second transportation path 9. The tip of the lever member 50 is located at a position where the detector portion 52 is provided.

The detector portion 52 includes a light-emitting portion 53 and a light-receiving portion 54. For example, a photo interrupter is used as the detector portion 52. An optical path having an optical axis L is formed between the light-emitting portion 53 and the light-receiving portion 54. When the lever member 50 is in its stationary position (position in the downward direction perpendicular to the horizontal plane), it blocks the optical path L. This position is hereinafter referred to as "reference position". The result of optical detection of the detector portion 52 is OFF when the lever member 50 is on the optical axis L and thus blocks the optical path. The result of optical detection of the detector portion 52 is ON when the lever member 50 is not on the optical axis L and thus does not block the optical path. With such ON/OFF switching, the detector portion 52 detects the change in the position of the lever member 50, thereby detecting the passing of the paper P therethrough.

Figure 4C:
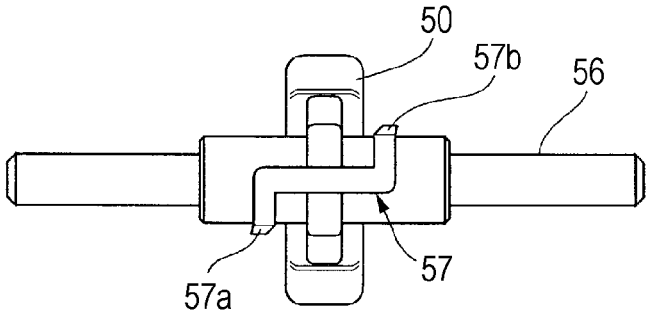
FIG. 4C is a plan view that schematically illustrates an example of the structure of the lever member according to an exemplary embodiment of the invention.
Figure 4A:
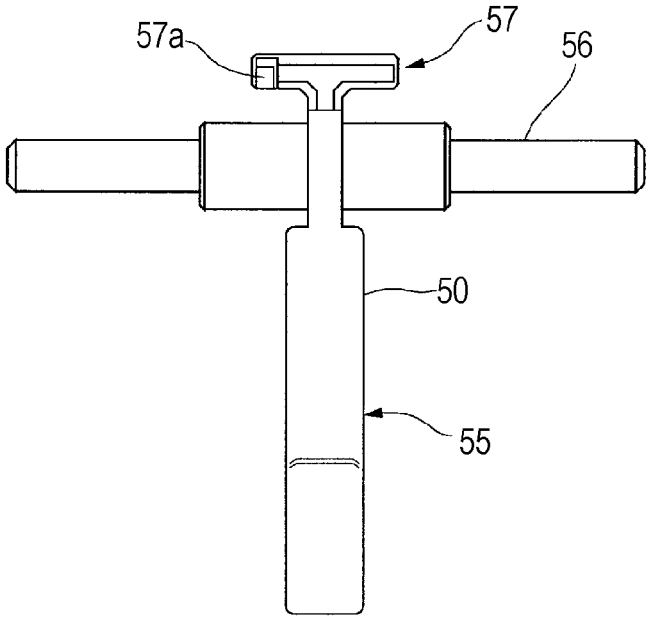
FIG. 4A is a front view that schematically illustrates an example of the structure of a lever member according to an exemplary embodiment of the invention.
Figure 4B:
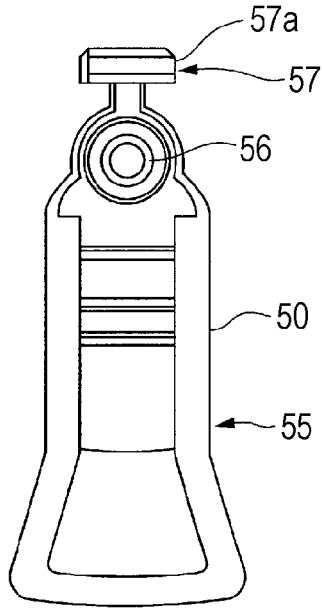
FIG. 4B is a left side view that schematically illustrates an example of the structure of the lever member according to an exemplary embodiment of the invention.

The actuator portion 51 includes a holder 60, a pair of torsion coil springs (urging member) 70, and a counter weight 80, besides the lever member 50. With reference to the accompanying part drawings, the structure of the components of the actuator portion 51 will now be explained. FIG. 4A is a front view that schematically illustrates an example of the structure of the lever member 50 according to the present embodiment of the invention. FIG. 4B is a left side view thereof. FIG. 4C is a plan view thereof. The lever member 50 has a contact portion 55. When the lever member 50 is in its reference position, the contact portion 55 is exposed over the second transportation path 9 in such a manner that the paper P can be brought into contact therewith. The contact portion 55 has a plate-like body that has a size increasing toward its tip in the direction of the transportation of the paper P (the X-axis direction). Because of such a structure, the contact portion 55 can block the optical path L in the detector portion 52 with a predetermined light block-off width.

The lever member 50 includes a rotating shaft 56 extending in the direction of the width of the transportation path (the Y-axis direction), which is orthogonal to the direction of the transportation of the paper P. The holder 60 rotatably supports each of the two ends of the rotating shaft 56 in the Y-axis direction. The center base part of the rotating shaft 56, which is located closer to the contact portion 55, has a larger diameter than each of the two end parts thereof. The diameter of the center base part of the rotating shaft 56 is slightly smaller than the inner diameter of the torsion coil spring 70.

The lever member 50 has a spring engagement portion (engagement portion) 57. The spring engagement portion 57 is located at the side opposite to the contact-portion side. The rotating shaft 56 is provided between the contact portion 55 and the spring engagement portion 57. The spring engagement portion 57 is a portion that is in engagement with the torsion coil spring 70. The torsion coil spring 70 applies an urging force to the spring engagement portion 57. The spring engagement portion 57 slightly extends in the direction opposite to the direction of the extension of the contact portion 55 from the rotating shaft 56. The distance between the far end of the spring engagement portion 57 and the rotating shaft 56 is shorter than the distance between the far end of the contact portion 55 and the rotating shaft 56. Because of such a structure, the center of gravity of the lever member 50 is located in the contact portion 55. In addition, the movement range of the spring engagement portion 57, which is a space that is necessary for the operation of the spring engagement portion 57, does not occupy too much space. The spring engagement portion 57 has a shape that looks like alphabet letter T. The spring engagement portion 57 has a protruding portion 57*a*, which is in engagement with the torsion coil spring 70 at the +X side, and a protruding portion 57*b*, which is in engagement with the torsion coil spring 70 at the −X side.

Figure 5C:
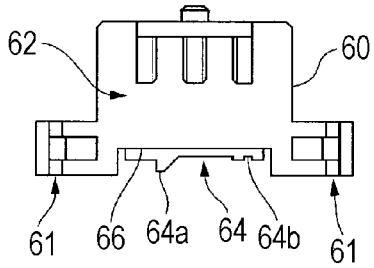
FIG. 5C is a plan view that schematically illustrates an example of the structure of the holder according to an exemplary embodiment of the invention.
Figure 5A:
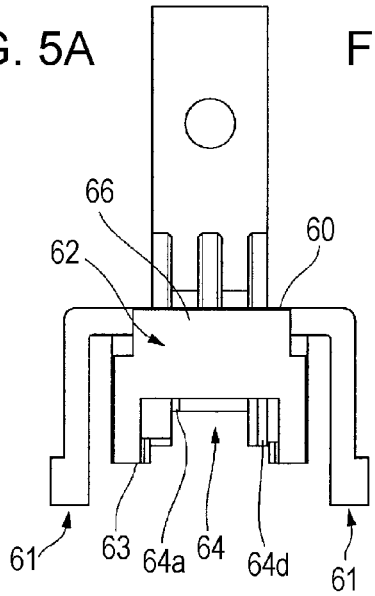
FIG. 5A is a front view that schematically illustrates an example of the structure of a holder according to an exemplary embodiment of the invention.
Figure 5B:
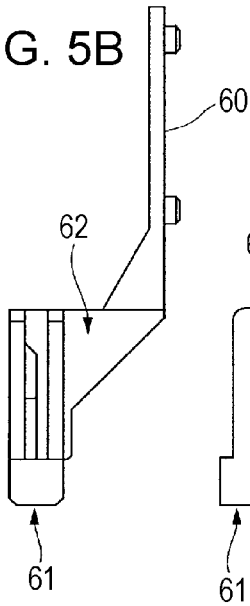
FIG. 5B is a right side view that schematically illustrates an example of the structure of the holder according to an exemplary embodiment of the invention.
Figure 5E:
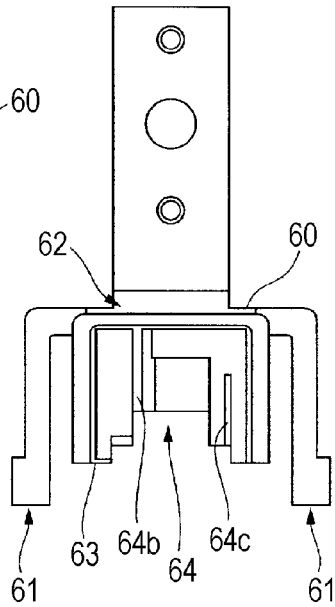
FIG. 5E is a rear view that schematically illustrates an example of the structure of the holder according to an exemplary embodiment of the invention.
Figure 5D:
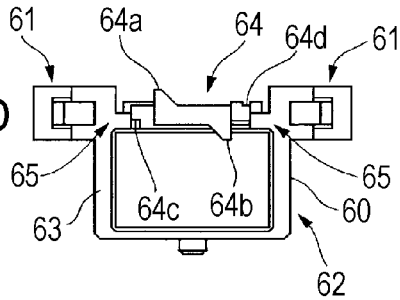
FIG. 5D is a bottom view that schematically illustrates an example of the structure of the holder according to an exemplary embodiment of the invention.

FIG. 5A is a front view that schematically illustrates an example of the structure of the holder 60 according to the present embodiment of the invention. FIG. 5B is a right side view thereof. FIG. 5C is a plan view thereof. FIG. 5D is a bottom view thereof. FIG. 5E is a rear view thereof. The holder 60 is screwed to the guide facing portion 37. The holder 60 supports the lever member 50 as a member that can turn. The holder 60 has bearing portions 61. The bearing portions 61 support the rotating shaft 56 of the lever member 50. The rotating shaft 56 can rotate around the Y axis freely. The bearing portions 61, which make up a pair, are formed at both sides of a holder body 62, respectively. The holder body 62 has a concave portion 64, which is a part recessed in the upward direction perpendicular to the horizontal plane (the +Z side) at the center of the bottom 63 of the holder body 62. The concave portion 64 is formed so that the spring engagement portion 57 can turn without any collision when the lever member 50 turns. Protruding portions 64*a* and 64*b* and groove portions 64*c* and 64*d*, which are in engagement with the torsion coil spring 70, are provided at positions corresponding to the position of the concave portion 64. The protruding portion 64*a* protrudes toward the +X side. The protruding portion 64*b* protrudes toward the −X side. The groove portion 64*c* is formed at the side where the protruding portion 64*b* is formed. The groove portion 64*d* is formed at the side where the protruding portion 64*a* is formed.

When a torque is given to the torsion coil spring 70 around its coil axis, the torsion coil spring 70 exerts a reaction force (urging force) (refer to FIG. 2). The torsion coil spring 70 is provided for the purpose of reducing time taken for the lever member 50 to return to the reference position as much as possible. In the present embodiment of the invention, the actuator portion 51 includes two torsion coil springs 70. Each of the two torsion coil springs 70 is attached to the larger-diameter base part of the rotating shaft 56. With such spring arrangement, it is possible to avoid the torsion coil spring 70 from being exposed over the second transportation path 9. Therefore, it is not obstructive when the paper P is transported. One end part of one of the two torsion coil springs 70 is in engagement with the groove portion 64*c* of the holder body 62. The other end part thereof is in engagement with, and across, the protruding portion 64*a* across, and with, the protruding portion 57*a* of the spring engagement portion 57 of the lever member 50. One end part of the other of the two torsion coil springs 70 is in engagement with the groove portion 64*d* of the holder body 62. The other end part thereof is in engagement with, and across, the protruding portion 64*b* across, and with, the protruding portion 57*b* of the spring engagement portion 57 of the lever member 50.

Figures 6A, 6B, 6C, 6D, 6E:
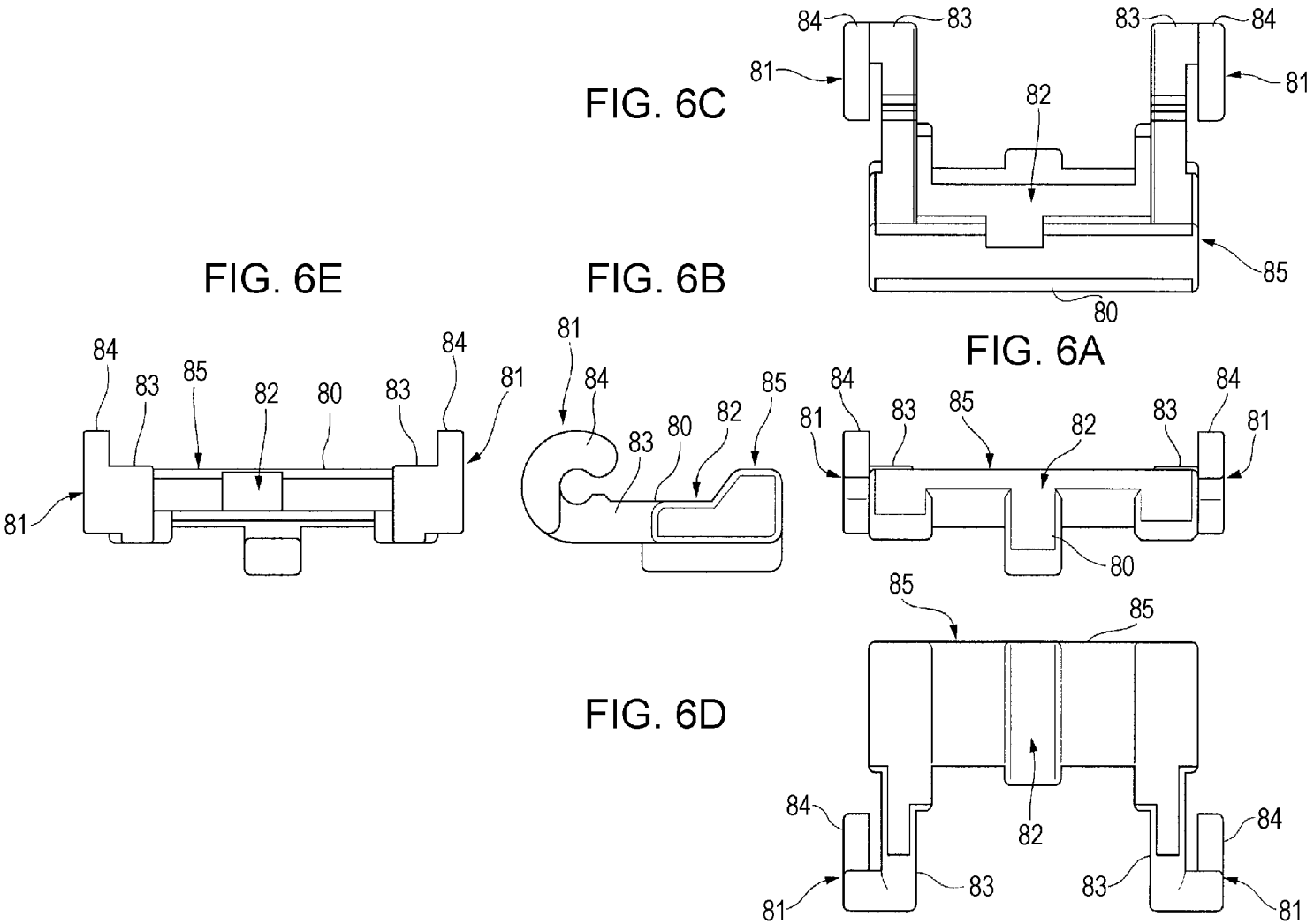
FIG. 6A is a front view that schematically illustrates an example of the structure of a counter weight according to an exemplary embodiment of the invention.
FIG. 6B is a left side view that schematically illustrates an example of the structure of the counter weight according to an exemplary embodiment of the invention.
FIG. 6C is a plan view that schematically illustrates an example of the structure of the counter weight according to an exemplary embodiment of the invention.
FIG. 6D is a bottom view that schematically illustrates an example of the structure of the counter weight according to an exemplary embodiment of the invention.
FIG. 6E is a rear view that schematically illustrates an example of the structure of the counter weight according to an exemplary embodiment of the invention.

FIG. 6A is a front view that schematically illustrates an example of the structure of the counter weight 80 according to the present embodiment of the invention. FIG. 6B is a left side view thereof. FIG. 6C is a plan view thereof. FIG. 6D is a bottom view thereof. FIG. 6E is a rear view thereof. When the lever member 50 turning around the rotating shaft 56 is brought into contact with the counter weight 80, the counter weight 80 receives the kinetic energy of the lever member 50. Due to the reception of the kinetic energy, the counter weight 80 moves to change its position (turns). Then, the counter weight 80 transfers the kinetic energy to the holder 60. Utilizing the law of conservation of energy, the counter weight 80 provides a solution to the problem of chattering. The counter weight 80 has substantially the same mass as that of the lever member 50 so that it can move with substantially the same moment of inertia as that of the lever member 50. The counter weight 80 is shaped like a plate with ribs.

The counter weight 80 can rotate around an axis that is the same as the rotating shaft 56 of the lever member 50 freely. The counter weight 80 has hook portions 81, which are in engagement with the rotating shaft 56 of the lever member 50 in a freely rotatable manner. The hook portions 81, which make up a pair, are formed at both sides of a counter body 82, respectively. Each of the two hook portions 81 protrudes from and along the corresponding one of the two sides of the counter body 82 (in the −X direction). The hook portion 81 has a straight extending portion 83 and an ear-shaped bearing portion 84. The straight portion 83 extends in the −X direction. The ear-shaped bearing portion 84 is formed at the −X end of the extending portion 83. The upper-surface side of the extending portion 83 has a structure that makes it possible for the extending portion 83 to be brought into contact with a motion restriction portion 65 formed at the bottom 63 of the holder body 62 (refer to FIG. 5D). The counter body 82 has an end portion 85 at the side opposite to the side where the hook portions 81 are formed. The end portion 85 bulges in the upward direction perpendicular to the horizontal plane (in the +Z direction) (refer to FIG. 6B).

Figure 7:
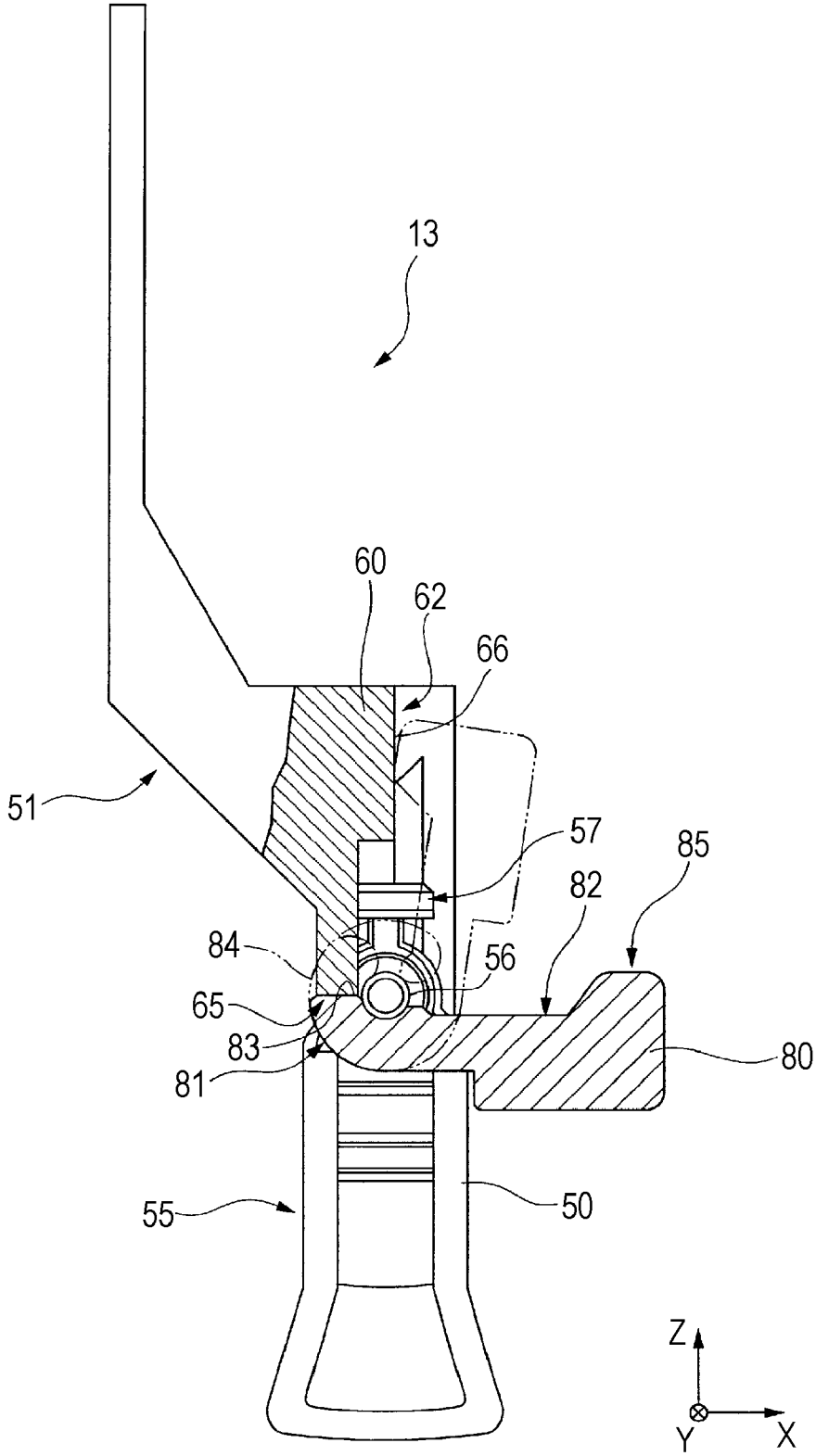
FIG. 7 is a diagram that schematically illustrates an example of a range in which the counter weight according to an exemplary embodiment of the invention can turn.

FIG. 7 is a diagram that schematically illustrates an example of a range in which the counter weight 80 according to the present embodiment of the invention can turn. The turn of the counter weight 80 is restricted to an angular range of approximately 90° between a substantially horizontal position (the lower limit) and, roughly speaking, a vertical position (the upper limit), which is above the substantially horizontal position, by the holder 60. In an original state, the extending portion 83 of the counter weight 80 is in contact with the motion restriction portion 65 of the holder 60 at the side opposite to the side where the counter body 82 is located with the rotating shaft 56 of the lever member 50 being provided between the two sides. In this state, the counter weight 80 is held in the substantially horizontal position, that is, substantially parallel to the X-Y plane. When the counter weight 80 is held in the substantially horizontal position, it is not in contact with the lever member 50 that is now in the reference position due to the restriction.

When the counter weight 80 turns to the roughly vertical position, the end portion 85 of the counter weight 80 is brought into contact with a flat portion (a second restricting portion) 66 of the holder body 62. The flat portion 66 restricts the upward turn of the counter weight 80 as an upper stopper. The flat portion 66 is located at substantially the same level as that of the rotating shaft 56 in the Y-Z plane. Since the end portion 85 of the counter weight 80 has a bulged shape, even when it is in contact with the flat portion 66, the center of gravity of the counter weight 80 is located in the range of the turn of the counter weight 80. For this reason, when the counter weight 80 has turned to the roughly vertical position, which is the upper limit in the range of the turn thereof, a torque for turning back therefrom to the substantially horizontal position, which is the lower limit in the range of the turn thereof, acts due to its own weight. Thus, it is possible to avoid a state in which the counter weight 80 comes to a standstill at the roughly vertical position.

Next, with reference to FIGS. 8A to 11B, the operation of the paper edge detection sensor 13 having the structure explained above will now be explained. With reference to FIGS. 8A, 8B, 8C, 9A, 9B, and 9C, the operation of the paper edge detection sensor 13 at the time of single-side printing, that is, when the paper P is transported in the forward direction (in the +X direction), will now be explained.

Figure 8A:
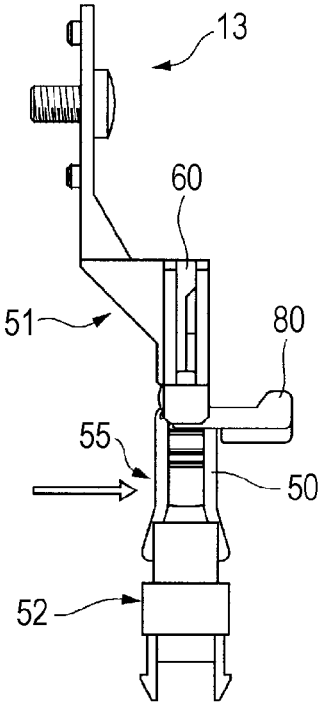
FIG. 8A is a diagram that schematically illustrates an example of the operation of a paper edge detection sensor according to an exemplary embodiment of the invention when paper is transported in the forward direction.
Figure 8B:
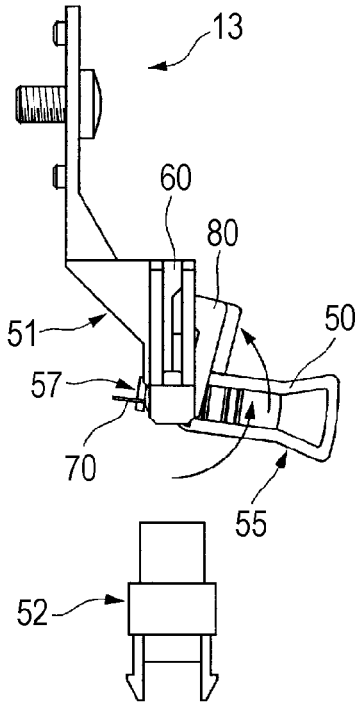
FIG. 8B is a diagram that schematically illustrates an example of the operation of the paper edge detection sensor according to an exemplary embodiment of the invention when paper is transported in the forward direction.

When the paper P is transported in the forward direction as illustrated in FIG. 8A, it collides with the contact portion 55 of the lever member 50 that is in the reference position as its original state. Since the holder 60 supports the lever member 50 in such a manner that the lever member 50 can turn freely toward both sides in the direction of the transportation of the paper P, as a result of the paper collision, the lever member 50 moves to change its position (turns) toward the +X side around the rotating shaft 56. FIG. 8B illustrates a position of the lever member 50 at the time of the passing of the paper P therethrough. The lever member 50 is held in a position at which the contact portion 55 is located at the +X side because the paper P is in contact therewith. When the lever member 50 turns to the above position, the contact portion 55 is brought into contact with the counter weight 80 to raise the counter weight 80 from the substantially horizontal position to the roughly vertical position.

In addition, when the lever member 50 is in the above position, the spring engagement portion 57, which is provided at the side opposite to the contact-portion side, is located at the −X side. When the spring engagement portion 57 turns to the −X side, a reaction force is exerted around the coil axis at the ends of the torsion coil springs 70 attached to the rotating shaft 56 in engagement with the spring engagement portion 57. For this reason, when the lever member 50 is in the above position, an urging force for returning to the reference position acts thereon. Moreover, since this position of the lever member 50 is above the reference position, potential energy has been accumulated. Therefore, a force for turning back to the reference position acts due to its own weight. Since the lever member 50 is exposed from the guide facing portion 37 toward the second transportation path 9, it is possible to hold the paper P along the guide surface when the paper P passes therethrough by means of the lever member 50 due to its own weight and the urging force.

Figure 8C:
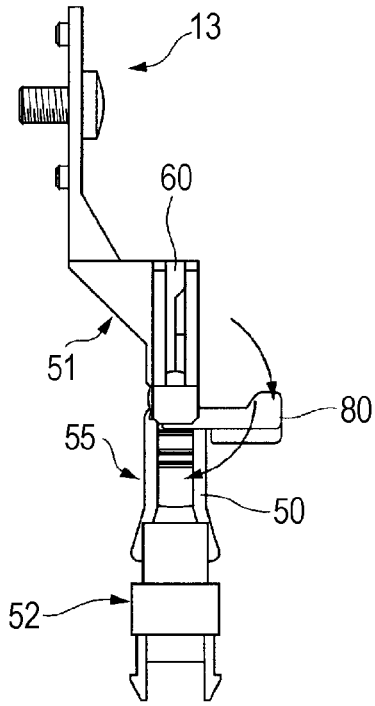
FIG. 8C is a diagram that schematically illustrates an example of the operation of the paper edge detection sensor according to an exemplary embodiment of the invention when paper is transported in the forward direction.

After the passing of the paper P therethrough, as illustrated in FIG. 8C, the lever member 50 turns back to the reference position due to its own weight and the urging force. Since the lever member 50 turns back toward the reference position, the counter weight 80, which was raised by the lever member 50, turns back toward the substantially horizontal position due to its own weight. Since the urging force as well as its own weight acts on the lever member 50, the speed of the return movement of the lever member 50 is higher than the speed of the return movement of the counter weight 80, which the weight of its own only acts on. For this reason, collision does not occur between the lever member 50 and the counter weight 80 during the return movement. Since the upper surface of the extending portion 83 is brought into contact with the motion restriction portion 65 of the holder 60 when the counter weight 80 reaches the substantially horizontal position, the return movement of the counter weight 80 is stopped thereat. Thus, the counter weight 80 is held in a position that is the same as the original position with the extending portion 83 being in contact with the motion restriction portion 65 of the holder 60.

Figure 9A:
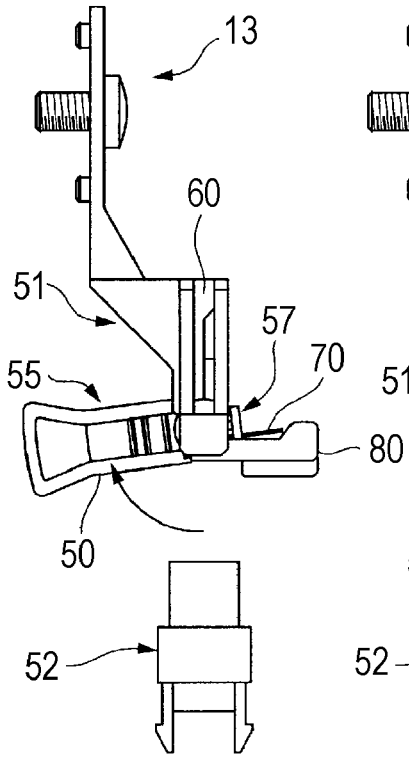
FIG. 9A is a diagram that schematically illustrates an example of the operation of the paper edge detection sensor according to an exemplary embodiment of the invention when paper is transported in the forward direction.

On the other hand, as illustrated in FIG. 9A, the lever member 50 overshoots, that is, turns from the reference position to the −X side, because of the force of inertia at the time of the return movement. When the lever member 50 is put into the negative overshoot state, the spring engagement portion 57 turns to the +X side. As a result, a reaction force is exerted around the coil axis at the ends of the torsion coil springs 70 attached to the rotating shaft 56 in engagement with the spring engagement portion 57. Consequently, an urging force for returning to the reference position for canceling the overshoot acts on the lever member 50.

Figure 9B:
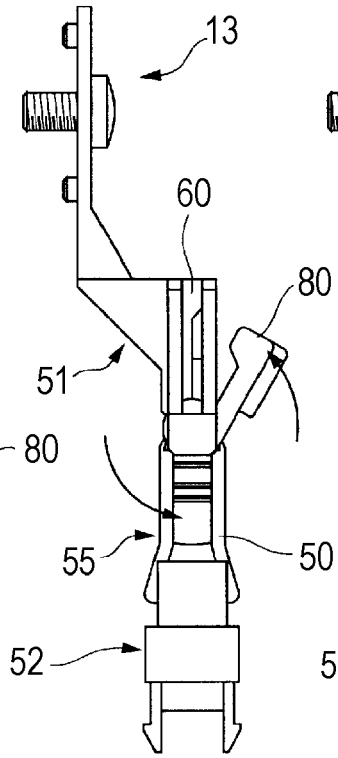
FIG. 9B is a diagram that schematically illustrates an example of the operation of the paper edge detection sensor according to an exemplary embodiment of the invention when paper is transported in the forward direction.

Next, as illustrated in FIG. 9B, the lever member 50 turns back to the reference position due to its own weight and the urging force. The lever member 50 overshoots slightly from the reference position to the +X side because of the force of inertia at the time of the return movement. The lever member 50 collides with the counter weight 80, which is held at the substantially horizontal position. Since the counter weight 80 has substantially the same inertia (inertial mass) as that of the lever member 50, when the lever member 50 collides with the counter weight 80, kinetic energy exchange occurs. The counter weight 80 receives the kinetic energy of the lever member 50 to move to change its position around the rotating shaft 56 while stopping the lever member 50. Since the kinetic energy of the lever member 50 is reduced to zero because of the collision with the counter weight 80, the lever member 50 stops at the reference position. On the other hand, the counter weight 80 turns to a predetermined height where all of the received kinetic energy is used up due to conversion into potential energy.

Figure 9C:
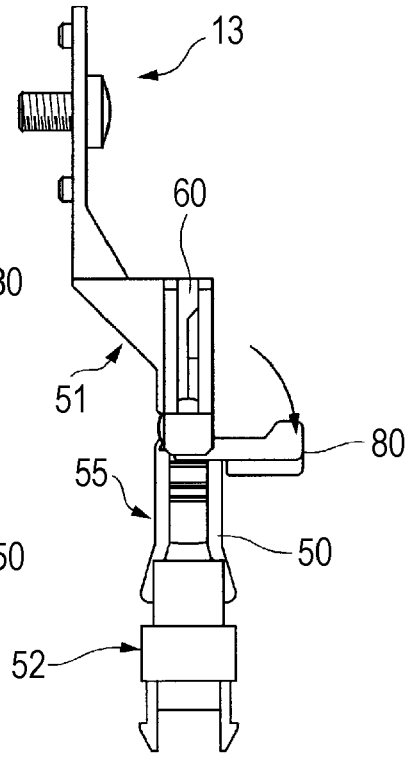
FIG. 9C is a diagram that schematically illustrates an example of the operation of the paper edge detection sensor according to an exemplary embodiment of the invention when paper is transported in the forward direction.

After having been raised to the predetermined height, as illustrated in FIG. 9C, the counter weight 80 turns back to the substantially horizontal position due to its own weight. As a result of the collision of the motion restriction portion 65 with the extending portion 83, the holder 60 stops the return movement of the raised counter weight 80 due to its own weight at a position in front of a position where the counter weight 80 would be otherwise brought into contact with the lever member 50 that is in the reference position. Because of the collision with the motion restriction portion 65, the counter weight 80 can transfer its kinetic energy to the holder 60 and allow it to escape in a substantially vertical direction without colliding with the lever member 50. By this means, it is possible to avoid chattering caused by the lever member 50. In addition, since the extending portion 83 of the counter weight 80 turning back due to its own weight is brought into contact with the motion restriction portion 65 in front of the position where the counter weight 80 would be otherwise brought into contact with the lever member 50 that is in the reference position, it is possible to efficiently transfer its kinetic energy to the holder 60 at the position where the speed of the return movement is the highest.

Next, with reference to FIGS. 10A, 10B, 10C, 11A, and 11B, the operation of the paper edge detection sensor 13 at the time of double-side printing, that is, when the paper P is transported in the backward direction (in the −X direction), will now be explained.

Figures 10A, 10B, 10C:
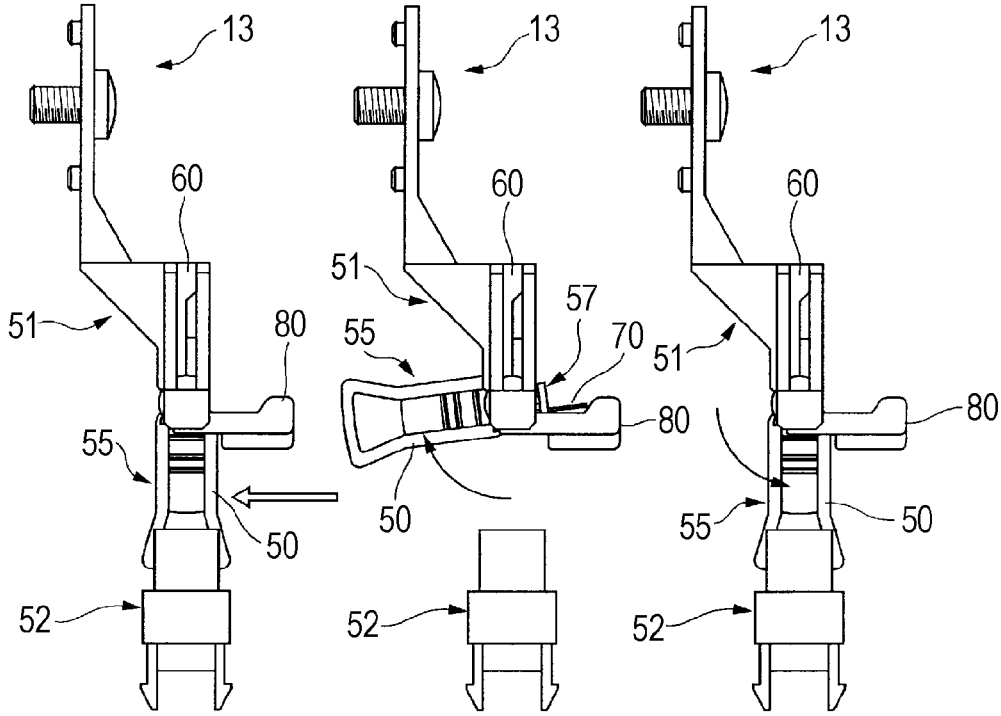
FIG. 10A is a diagram that schematically illustrates an example of the operation of the paper edge detection sensor according to an exemplary embodiment of the invention when paper is transported in the backward direction.
FIG. 10B is a diagram that schematically illustrates an example of the operation of the paper edge detection sensor according to an exemplary embodiment of the invention when paper is transported in the backward direction.
FIG. 10C is a diagram that schematically illustrates an example of the operation of the paper edge detection sensor according to an exemplary embodiment of the invention when paper is transported in the backward direction.

When the paper P is transported in the backward direction as illustrated in FIG. 10A, it collides with the contact portion 55 of the lever member 50 that is in the reference position as its original state. Since the holder 60 supports the lever member 50 in such a manner that the lever member 50 can turn freely toward both sides in the direction of the transportation of the paper P, as a result of the paper collision, the lever member 50 moves to change its position toward the −X side around the rotating shaft 56. FIG. 10B illustrates a position of the lever member 50 at the time of the passing of the paper P therethrough. The lever member 50 is held in a position at which the contact portion 55 is located at the −X side because the paper P is in contact therewith. When the lever member 50 turns to the above position, the spring engagement portion 57 turns to the +X side. As a result, a reaction force is exerted around the coil axis at the ends of the torsion coil springs 70 attached to the rotating shaft 56 in engagement with the spring engagement portion 57. Consequently, an urging force for returning to the reference position acts on the lever member 50. Moreover, since this position of the lever member 50 is above the reference position, potential energy has been accumulated. Therefore, a force for turning back to the reference position acts due to its own weight. Since the lever member 50 is exposed from the guide facing portion 37 toward the second transportation path 9, it is possible to hold the paper P along the guide surface when the paper P passes therethrough by means of the lever member 50 due to its own weight and the urging force.

After the passing of the paper P therethrough, as illustrated in FIG. 10C, the lever member 50 turns back to the reference position due to its own weight and the urging force. The lever member 50 overshoots slightly from the reference position to the +X side because of the force of inertia at the time of the return movement. The lever member 50 collides with the counter weight 80, which is held at the substantially horizontal position. Since the counter weight 80 has substantially the same inertia (inertial mass) as that of the lever member 50, when the lever member 50 collides with the counter weight 80, kinetic energy exchange occurs. The counter weight 80 receives the kinetic energy of the lever member 50 to move to change its position around the rotating shaft 56 while stopping the lever member 50 (refer to FIG. 11A). Since the kinetic energy of the lever member 50 is reduced to zero because of the collision with the counter weight 80, the lever member 50 stops at the reference position. On the other hand, the counter weight 80 turns to a predetermined height where all of the received kinetic energy is used up due to conversion into potential energy.

Figure 11A:
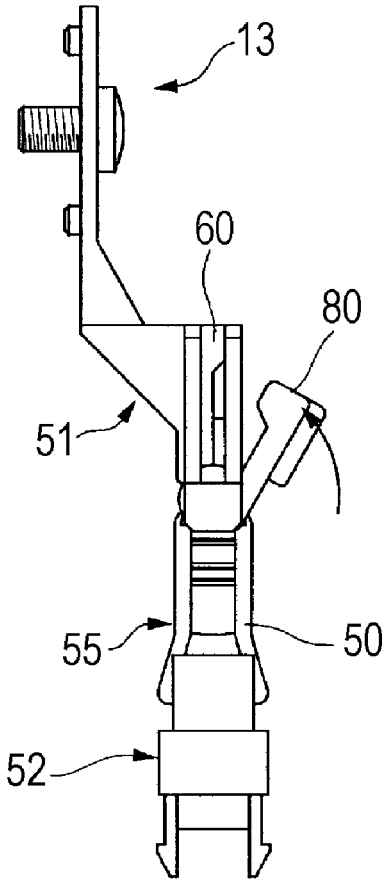
FIG. 11A is a diagram that schematically illustrates an example of the operation of the paper edge detection sensor according to an exemplary embodiment of the invention when paper is transported in the backward direction.
Figure 11B:
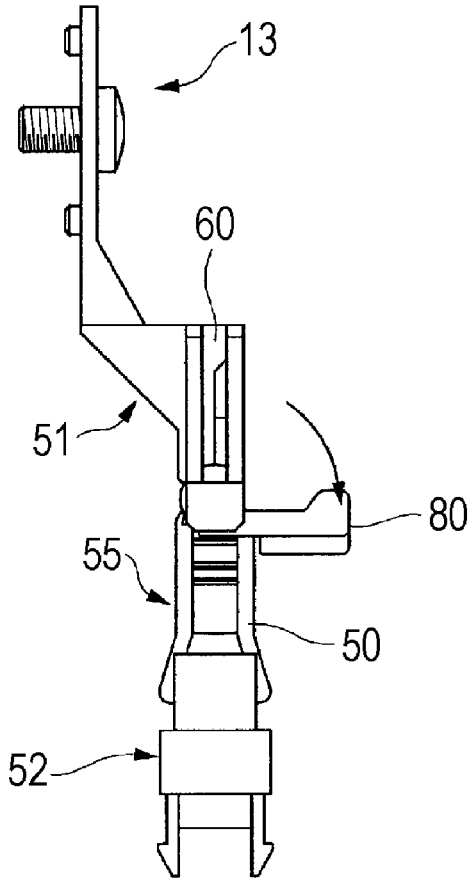
FIG. 11B is a diagram that schematically illustrates an example of the operation of the paper edge detection sensor according to an exemplary embodiment of the invention when paper is transported in the backward direction.

After having been raised to the predetermined height, as illustrated in FIG. 11B, the counter weight 80 turns back to the substantially horizontal position due to its own weight. As a result of the collision of the motion restriction portion 65 with the extending portion 83, the holder 60 stops the return movement of the raised counter weight 80 due to its own weight at the position in front of the position where the counter weight 80 would be otherwise brought into contact with the lever member 50 that is in the reference position. Because of the collision with the motion restriction portion 65, the counter weight 80 can transfer its kinetic energy to the holder 60 and allow it to escape in the substantially vertical direction without colliding with the lever member 50. By this means, it is possible to avoid chattering caused by the lever member 50.

As described above, the paper edge detection sensor 13 according to the present embodiment of the invention includes the counter weight 80 that can turn. The kinetic energy of the lever member 50 at the time of turning back to the original position after having been released from the paper P is transferred to the counter weight 80. With the utilization of the law of conservation of energy, it is possible to prevent chattering from occurring. In addition, since the counter weight 80, which is a movable member, is used as a substitute for a conventional fixed stopper, the paper edge detection sensor 13 can work not only in the forward transportation of the paper P but also in the backward transportation thereof. Thus, it can be used for detection in double-side printing on the same transportation path.

The scope of the invention is not limited to the embodiment explained above with reference to the accompanying drawings. The shape of each of the constituent members described in the foregoing embodiment, a combination thereof, and the like are specified merely for the purpose of explanation. They may be modified, altered, changed, adapted, and/or improved within a range not departing from the gist and/or spirit of the invention apprehended by a person skilled in the art from explicit and implicit description given herein, for example, to satisfy design requirements.

For example, though the counter weight 80 is provided at the +X side only to save space in the foregoing embodiment of the invention, the counter weights 80 may be provided both at the +X side and the −X side, respectively, without any overshoot shown in FIG. 9A.

In the foregoing embodiment of the invention, an ink-jet printer is taken as an example of a recording apparatus. However, the scope of the invention is not limited thereto. For example, the invention can be applied to a copying machine, a fax machine, or the like.

What is claimed is:

1. A sheet material detection apparatus that detects passage of a sheet material over a sheet material transportation path, comprising:

a lever member that is exposed over the transportation path and moves to change its position from a reference position when the sheet material is brought into contact therewith;

a detecting section that detects the change in the position of the lever member;

a holder that supports the lever member in such a manner that the lever member can turn freely toward both sides in a direction of the transportation of the sheet material at a guide-facing-surface side, the guide facing surface being a surface facing a guide surface along which the sheet material is guided over the transportation path;

a counter weight with which the lever member moving to change the position is brought into contact, the counter weight moving to change its position due to contact with the lever member, the counter weight being thereafter brought into contact with the holder; and an urging member that urges the lever member after the change in the position toward the reference position, wherein the urging member is, for urging, in engagement with an engagement portion of the lever member that is located at a side opposite to a side of a contact portion of the lever member with a rotating shaft of the lever member being supported by the holder between the engagement portion and the contact portion, which is a portion with which the sheet material is brought into contact.

2. The sheet material detection apparatus according to claim 1, wherein a distance from the rotating shaft to the engagement portion is shorter than a distance from the rotating shaft to the contact portion.

3. The sheet material detection apparatus according to claim 2, wherein the holder includes a restricting portion with which the counter weight is brought into contact, thereby restricting return movement of the counter weight due to its own weight after the change in the position at a side in front of a position where the counter weight would be otherwise brought into contact with the lever member that is in the reference position.

4. The sheet material detection apparatus according to claim 3, wherein the counter weight can turn freely around a predetermined axis; and the holder restricts a range in which the counter weight can turn between a substantially horizontal position, which is a position where the counter weight is brought into contact with the restricting portion, and a roughly vertical position, which is a position where the counter weight is brought into contact with a second restricting portion, which is provided above the substantially horizontal position.

5. A recording apparatus comprising:

the sheet material detection apparatus according to claim 1; and a recording section that performs recording processing on the sheet material transported over the transportation path.

* * * * *